US006230333B1

(12) United States Patent
Umeda

(10) Patent No.: US 6,230,333 B1
(45) Date of Patent: May 15, 2001

(54) LIFE JACKET WITH CUSHIONING AIR-BAG

(75) Inventor: Makoto Umeda, Kumamoto (JP)

(73) Assignee: Safety Corporation, Kumamoto (JP)

( * ) Notice: Subject to any disclaimer, the term of this patent is extended or adjusted under 35 U.S.C. 154(b) by 0 days.

(21) Appl. No.: 09/359,725

(22) Filed: Jul. 23, 1999

(30) Foreign Application Priority Data

Dec. 21, 1998 (JP) ..... 10-378189

(51) Int. Cl.[7] ..... A41D 13/00
(52) U.S. Cl. ..... 2/463; 2/465; 2/DIG. 3
(58) Field of Search ..... 2/463, 465, 467, 2/468, 92, 102, DIG. 3, 462

(56) References Cited

U.S. PATENT DOCUMENTS

| | | | | |
|---|---|---|---|---|
| 1,144,150 | * | 6/1915 | Marcovsky | 2/465 X |
| 4,059,852 | * | 11/1977 | Crane | 2/DIG. 3 |
| 4,685,151 | * | 8/1987 | Kincheloe | 2/DIG. 3 |
| 5,091,992 | * | 3/1992 | Pusic | 2/465 X |
| 5,133,084 | * | 7/1992 | Martin | 2/DIG. 3 |
| 5,781,936 | * | 7/1998 | Aaloof | 2/DIG. 3 |
| 5,867,842 | * | 2/1999 | Pinsley et al. | 2/DIG. 3 |
| 5,937,443 | * | 8/1999 | Kageyama et al. | 2/DIG. 3 |

FOREIGN PATENT DOCUMENTS

| | | | | |
|---|---|---|---|---|
| 2717234 | * | 11/1978 | (DE) | 2/468 |
| 4234009 | * | 4/1994 | (DE) | 2/463 |
| 43990 | * | 1/1982 | (EP) | 2/467 |

* cited by examiner

*Primary Examiner*—Rodney M. Lindsey
(74) *Attorney, Agent, or Firm*—Wenderoth, Lind & Ponack, L.L.P.

(57) ABSTRACT

A life jacket with a cushioning air-bag comprises a jacket body (1), which includes a continuous torso air-bag portion (7) having a chest air-bag portion (2), a back air-bag portion (3), and a side air-bag portion (4), and further includes a neck air-bag portion (5) and a waist air-bag portion (6). The jacket body is provided with a gas generator (8) having a gas cartridge. Each of the air-bag portions (2, 3, 4, 5 and 6) has a dual structure composed of an outer bag (9) and an inner bag (10), which bags (9 and 10) are made of synthetic resin such as urethane or vinyl chloride. The gas generator (8) is connected to the outer bag (9) and inner bag (10) of each of the air bag portions (2, 3, 4, 5 and 6).

7 Claims, 6 Drawing Sheets

LIFE JACKET WITH CUSHIONING AIR-BAG

BACKGROUND OF THE INVENTION

1. Field of the Invention

This invention relates to a life jacket with a cushioning air-bag which can be used when a marine or land traffic emergency or accident has occurred. More particularly, it relates to a life jacket with a cushioning air-bag which can be used for easing an impact which would be imparted upon to a driver or a fellow rider of a motorcycle or a bicycle when such driver or rider of the motorcycle or bicycle should accidentally fall down during running.

2. Prior Art

A typical conventional life jacket with a cushioning air-bag of this type has cushioning air-bag portions each attached to corresponding regions of the chest and back of a life jacket body. The air-bag portions are attached with a gas cartridge for charging gas therein. A gas outlet port formed in the gas cartridge is in communication with the air-bag portions. The gas cartridge is attached with a manual gas generator for providing gas from the gas cartridge into the air-bag portions to inflate them for a cushioning purpose when an emergency or accident has occurred.

However, the above conventional life jacket with a cushioning air-bag has the following shortcomings. Since the gas generator is very large and heavy, the jacket itself is heavy and bulky. Thus, it is inconvenient for the wearer to take it on or put it off. Moreover, the operation for generating gas is troublesome and time consuming, and the cushioning air-bag of the life jacket is weak and readily broken. In addition, it can protect only a part of an upper area of the wearer's body i.e., driver's body from an impact and cannot fully protect the entire upper area of the body.

SUMMARY OF THE INVENTION

It is, therefore, a general object of the present invention to provide a life jacket with a cushioning air-bag which can instantaneously protect, when an emergency or accident has occurred, an entire upper area of the wearer's body such as the chest portion, the back portion, the side portion and the waist portion with a simple and easy operation made by the driver and/or the fellow rider furthermore, respective air-bag portions placed within the jacket body are of a duplex structure so that they are not easily broken by impact, thus preventing leakage of air gas.

A life jacket with a cushioning air-bag according to the present invention comprises a jacket body, the jacket body being attached with a chest air-bag portion, a back air-bag portion, a side air-bag portion, a neck air-bag portion and a waist air-bag portion. The respective air-bag portions are each of a duplex structure composed of an outer bag and an inner bag. A gas generator having a gas cartridge is attached to a predetermined position of the jacket body. The gas generator is connected to the outer bags and the inner bags of the respective air-bag portions.

The above and other objects, characteristic features and advantages of the present invention will become more apparent to those skilled in the art by the following description of the preferred embodiment of the invention, as illustrated in the accompanying drawings.

BEST MODE FOR CARRYING OUT THE INVENTION

Figure 1:
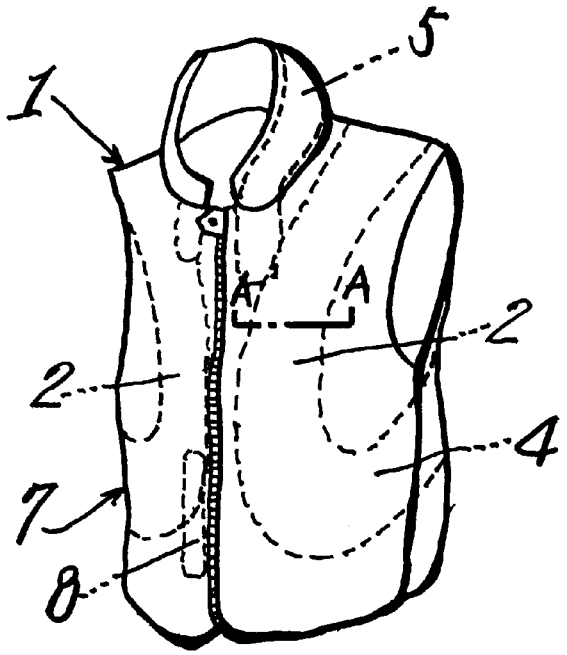
FIG. 1 is a perspective view of a life jacket according to one embodiment of the present invention.
Figure 2:
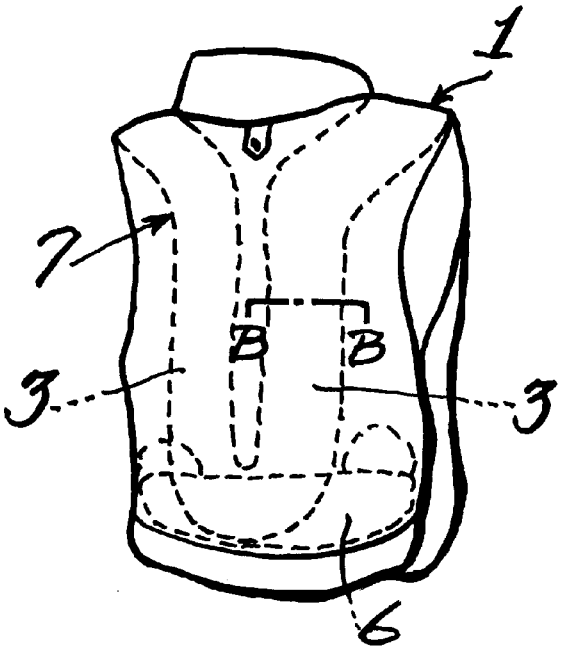
FIG. 2 is a back view of the life jacket of FIG. 1.

Reference numeral 1 denotes a jacket body such as a waistcoat, a vest, or a jumper. The jacket body 1 includes an inner liner having a continuous torso air-bag portion 7 integrally formed of a front chest air-bag portion 2, a back air-bag portion 3 and a side air-bag portion 4.

Figure 7:
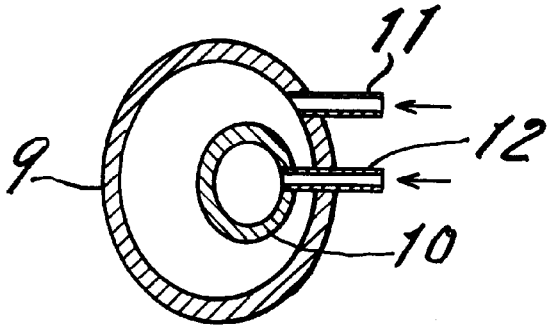
FIG. 7 is a vertical sectional side view of a modification similar to FIG. 6.
Figure 8:
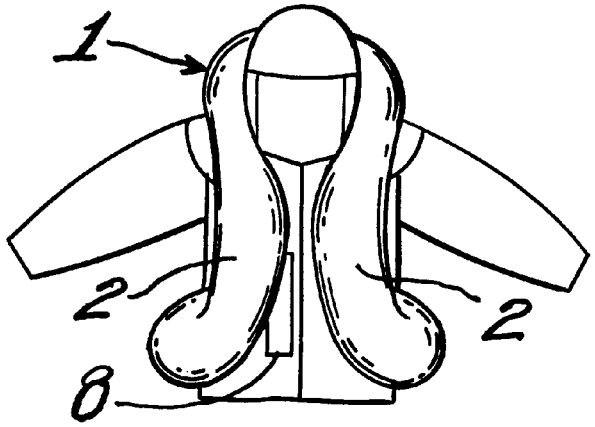
FIG. 8 is a front view of a life jacket filled with gas, according to one embodiment of the present invention.
Figure 9:
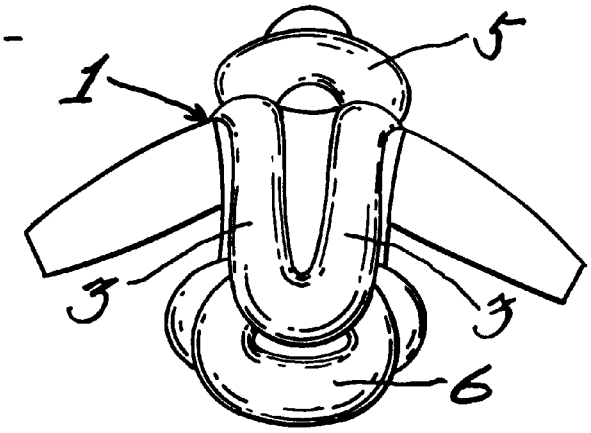
FIG. 9 is a back view of a life jacket filled with gas, according to one embodiment of the present invention.
Figure 10:
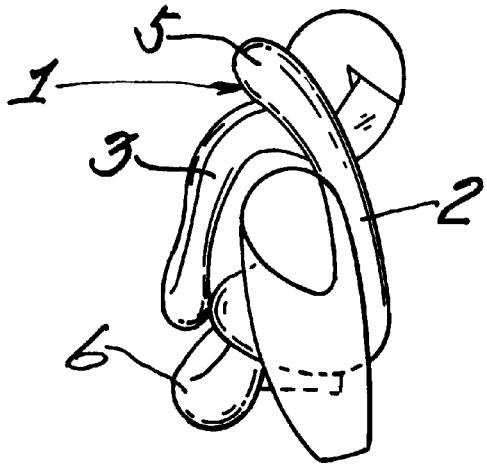
FIG. 10 is a side view of a life jacket filled with gas, according to one embodiment of the present invention.

As shown in FIG. 7, the continuous torso air-bag portion 7 comprising the chest air-bag portion 2, a back air-bag portion 3 and a side air-bag portion 4 has a duplex structure composed of an outer bag 9 and an inner bag 10 which are formed of synthetic resin such as urethane and vinyl chloride. The outer bag 9 and the inner bag 10 composing the duplex structure are connected together by high frequency sealing, and they are attached to the jacket body 1. The continuous torso air-bag portion 7 is provided at one end thereof with a gas inlet port 11 for charging gas into the outer bag 9 and a gas inlet port 12 for charging gas into the inner bag 10. The continuous torso air-bag portion 7 is, when gas is charged therein, inflated to provide a cushioning function.

Figure 3:
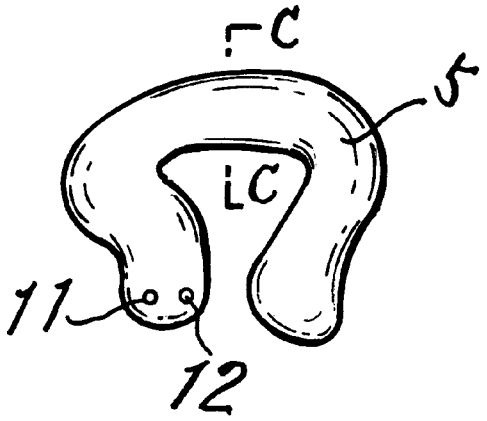
FIG. 3 is a perspective view of a neck air-bag portion which is to be attached to the life jacket, according to one embodiment of the present invention.
Figure 4:
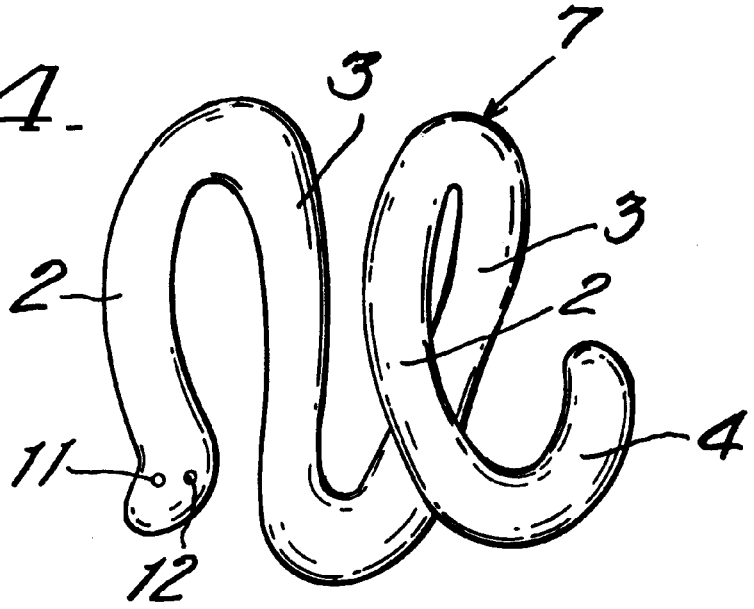
FIG. 4 is a perspective view of a continuous air-bag portion integrally formed of a chest air-bag portion, a back air-bag portion and a side air-bag portion, which are to be attached to the life jacket, according to the present invention.

A neck air-bag portion 5 shown in FIG. 3 is inserted into the interior of a scruff portion of the jacket body 1. It has a duplex structure composed of the outer bag 9 and the inner bag 10 which are made of synthetic resin such as urethane and vinyl chloride. The outer bag 9 and the inner bag 10 composing the duplex structure are connected together by high frequency sealing, and they are attached to a scruff portion of the jacket body 1. The neck air-bag portion 5 is provided at one end thereof with a gas inlet port 11 for charging gas into the outer bag 9 and a gas inlet port 12 for charging gas into the inner bag 10.

Figure 5:
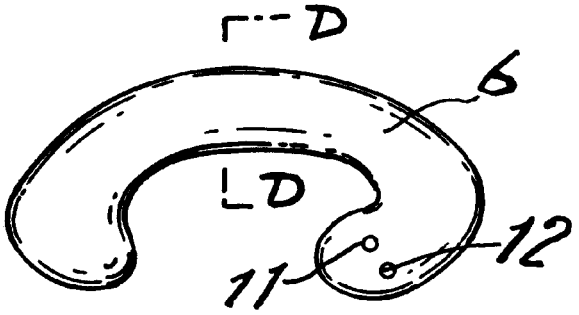
FIG. 5 is a perspective view of a waist air-bag portion which is to be attached to a life jacket, according to the present invention.
Figure 6:
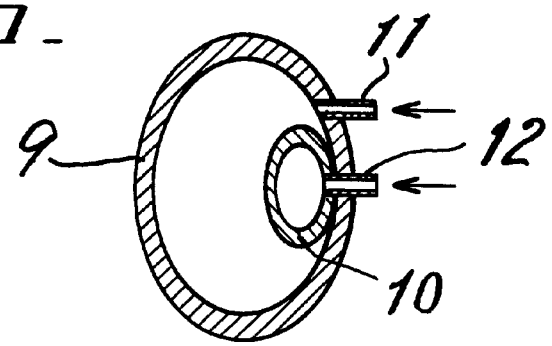
FIG. 6 is a vertical sectional side view taken on line A—A of FIG. 1, line B—B of FIG. 2, line C—C of FIG. 3, and line D—D of FIG. 5.

FIG. 5 shows a waist air-bag portion 6 which is to be placed on a lower portion of the back of the jacket body 1. The waist air-bag portion 6 has, like the neck air-bag portion 5, a duplex structure composed of the outer bag 9 and the inner bag 10 which are made of synthetic resin such as urethane and vinyl chloride. The waist air-bag portion 6 is provided at one end thereof with a gas inlet port 11 for charging gas into the outer bag 9 and a gas inlet port 12 for charging gas into the inner bag 10.

Figure 11:
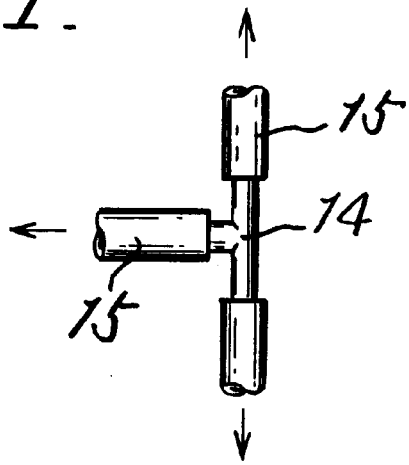
FIG. 11 is a front view of a state in which the respective air-bag portions of the jacket body according to one embodiment of the present invention are connected to a gas generator through vent hoses attached to a connecting piece.

The jacket body 1 is, as shown in FIG. 1, further provided at a predetermined position with a gas generator 8. The gas generator 8 is made of light-weight material such as stainless steel, aluminum, or synthetic resin. The gas generator 8 is connected to the gas inlet ports 11 and 12 of the outer and inner bags 9 and 10 of the continuous torso air-bag portion 7, neck air-bag portion 5 and waist air-bag portion 6 through vent hoses 15 which are attached to a connecting piece 14 of FIG. 11.

Figure 12:
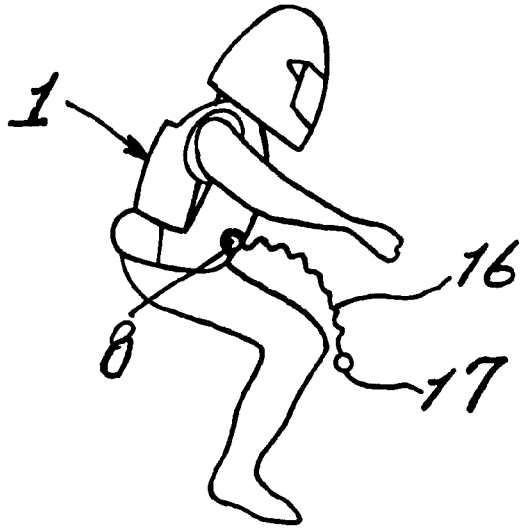
FIG. 12 is a side view of a driver in a driving posture, with a life jacket according to one embodiment of the present invention.
Figure 13:
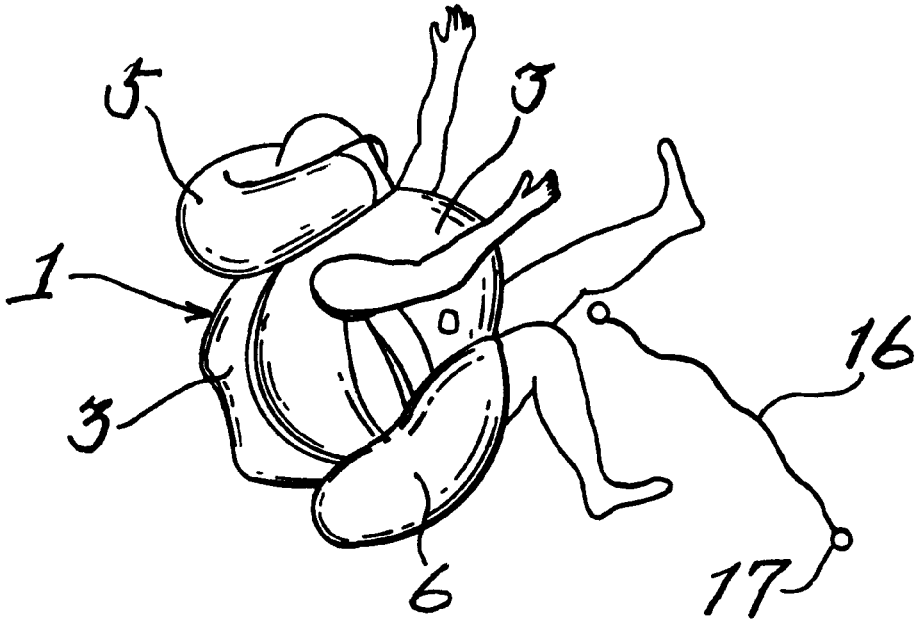
FIG. 13 is a side view showing an inflated state of an air-bag of a life jacket according to one embodiment of the present invention, and which occurs when a driver with the life jacket has accidentally fallen down.
Figure 14:
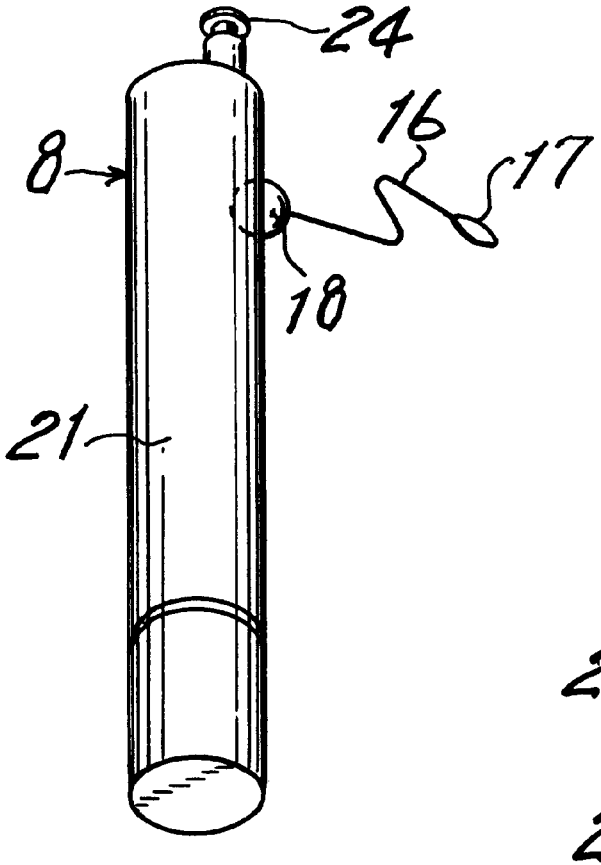
FIG. 14 is a perspective view of a gas generator which is to be attached to a life jacket according to one embodiment of the present invention.
Figure 15:
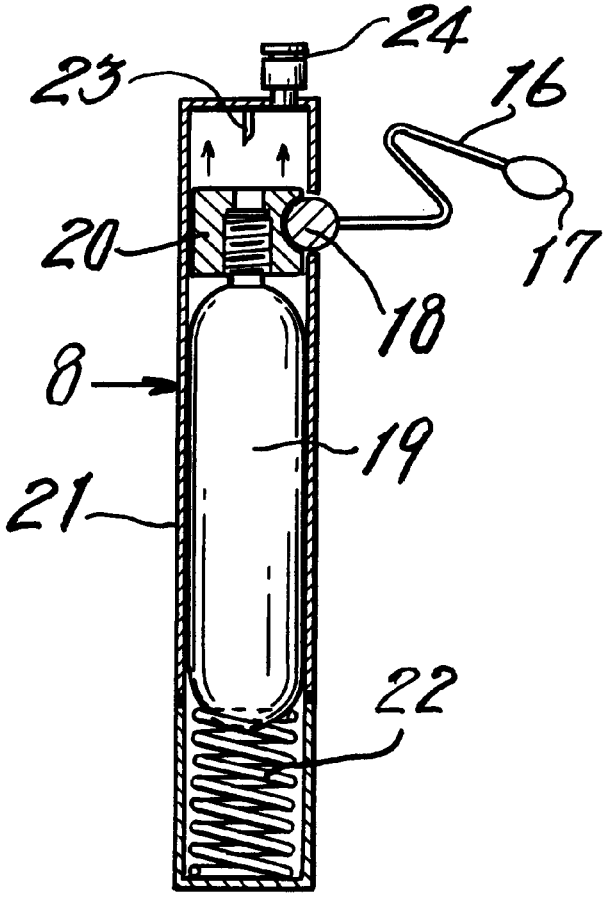
FIG. 15 is a vertical sectional front view of a gas generator which is to be attached to a life jacket according to the present invention.

The gas generator 8 is provided with a movable spherical pin 18 connected with a connecting string 16 having a connecting ring 17 at its one end as shown in FIGS. 12 and 13. It is also provided with a gas cartridge 19 filled therein with carbon dioxide ($CO_2$) and nitrogen gas ($N_2$). The movable spherical pin 18 is in engagement with a sliding member 20 attached to the gas cartridge 19. By pulling the connecting string 16, the movable spherical pin 18 is removed from a casing 21 of the gas generator 8 so that the gas cartridge 19 biased by a spring 22 is caused to collide against a striker 23 to generate gas. The gas thus generated is charged into the respective air-bags 5, 6 and 7 from the nozzle 24 through the connecting piece 14 and through the vent hoses 15 so that the air-bags 5, 6 and 7 can be inflated.

If the connecting ring 17 attached, as shown in FIG. 12, to one end of the connecting string 16 of the gas generator 8, is connected to a vehicle such as a motorcycle or a bicycle, the connecting string 16 is pulled when a falling accident has occurred as a result, the gas generator 8 is automatically opened to generate gas. The gas thus generated is charged into the chest air-bag portion 2, the back air-bag portion 3, the side air-bag portion 4, the neck air-bag portion 5 and the waist air-bag portion 6 through the vent hoses 15. The respective air-bag portions 2, 3, 4, 5 and 6 thus filled with gas are inflated to provide a cushioning function, thereby protecting the driver's body.

The life jacket with a cushioning air-bag according to the present invention can automatically protect the driver's body by reliably easing an impact which is to be imparted to an entire upper area from the waist bone of the driver's body. Since the chest air-bag portion, the back air-bag portion and the side air-bag portion are integrally formed, they can easily be attached to the jacket body. Further, since the respective air-bag portions have a duplex structure each composed of an outer bag and an inner bag, they are hardly susceptible to leakage of gas even when an impact is applied thereto. Thus, the leakage of gas can be prevented so that a sufficient cushioning function is provided.

Obviously, numerous modifications and variations of the present invention are possible in light of the above teachings. It is therefore to be understood that within the scope of the appended claims, the invention may be practiced otherwise than as specifically described herein.

What is claimed is:

1. A life jacket comprising:

a jacket body;

a continuous torso air-bag portion attached to said jacket body for protecting a wearer's chest, back, and sides, said continuous torso air-bag portion including a chest air-bag portion, a back air-bag portion, and a side air-bag portion integrally formed as a single unit, said continuous torso air-bag portion being formed of an inner bag and an outer bag lining said inner bag;

a continuous neck air-bag portion attached to said jacket body for protecting the wearer's neck, said continuous neck air-bag portion being formed of an inner bag and an outer bag lining said inner bag;

a continuous waist air-bag portion attached to said jacket body for protecting the wearer's waist, said continuous waist air-bag portion being formed of an inner bag and an outer bag lining said inner bag; and a gas generator attached to said jacket body and connected to said inner bag and to said outer bag of said continuous torso air-bag portion, connected to said inner bag and to said outer bag of said continuous neck air-bag portion, and connected to said inner bag and to said outer bag of said continuous waist air-bag portion so as to supply gas for filling each of said continuous torso air-bag portion, said continuous neck air-bag portion, and said continuous waist air-bag portion.

2. The life jacket of claim 1, wherein each of said continuous torso air-bag portion, said continuous neck air-bag portion, and said continuous waist air-bag portion is formed of a synthetic resin.

3. The life jacket of claim 2, wherein each of said continuous torso air-bag portion, said continuous neck air-bag portion, and said continuous waist air-bag portion is formed of one of urethane and vinyl chloride.

4. The life jacket of claim 1, wherein said continuous torso air-bag portion has an inner bag gas inlet connection connected to said gas generator for supplying gas into said inner bag of said continuous torso air-bag portion, and has an outer bag gas inlet connection connected to said gas generator for supplying gas into said outer bag of said continuous torso air-bag portion, said continuous neck air-bag portion has an inner bag gas inlet connection connected to said gas generator for supplying gas into said inner bag of said continuous neck air-bag portion, and has an outer bag gas inlet connection connected to said gas generator for supplying gas into said outer bag of said continuous neck air-bag portion, and said continuous waist air-bag portion has an inner bag gas inlet connection connected to said gas generator for supplying gas into said inner bag of said continuous waist air-bag portion, and has an outer bag gas inlet connection connected to said gas generator for supplying gas into said outer bag of said continuous waist air-bag portion.

5. The life jacket of claim 1, wherein said gas generator includes a gas cartridge for storing gas to be supplied for filling each of said continuous torso air-bag portion, said continuous neck air-bag portion, and said continuous waist air-bag portion.

6. The life jacket of claim 1, wherein said gas generator includes a spherical pin and a connecting string, a first end of said connecting string being connected to said spherical pin, and a second end of said connecting string to be connected to a vehicle.

7. The life jacket of claim 6, wherein said gas generator further includes a gas cartridge and a biasing spring, said spherical pin being located at a first end of said gas cartridge and said biasing spring being located at a second end of said gas cartridge so as to bias said gas cartridge against said spherical pin.

* * * * *